US006199790B1

(12) United States Patent
Maurer

(10) Patent No.: US 6,199,790 B1
(45) Date of Patent: Mar. 13, 2001

(54) REEL WINDING DEVICE AND PROCESS FOR SUPPORTING A WINDING REEL

(75) Inventor: Jörg Maurer, Steinheim (DE)

(73) Assignee: Voith Sulzer Papiertechnik Patent GmbH, Heidenheim (DE)

( * ) Notice: Subject to any disclaimer, the term of this patent is extended or adjusted under 35 U.S.C. 154(b) by 0 days.

(21) Appl. No.: 09/372,873

(22) Filed: Aug. 12, 1999

(30) Foreign Application Priority Data

Aug. 20, 1998 (DE) ..... 198 37 760

(51) Int. Cl.[7] ..... B65H 18/20
(52) U.S. Cl. ..... 242/541.7; 242/542
(58) Field of Search ..... 242/541.7, 542, 242/542.4, 541, 541.4, 541.5, 541.6

(56) References Cited

U.S. PATENT DOCUMENTS

| | | | | |
|---|---|---|---|---|
| 3,497,151 | * | 2/1970 | Voss et al. | 242/541.7 |
| 5,478,026 | * | 12/1995 | Schonmeier et al. | 242/542 X |
| 5,499,779 | * | 3/1996 | Raudaskoski | 242/541.4 |
| 5,505,403 | * | 4/1996 | Raudaskoski | 242/541.4 X |
| 5,556,053 | * | 9/1996 | Henseler | 242/541.6 |
| 5,823,463 | * | 10/1998 | Fissmann et al. | 242/541.7 |
| 5,855,337 | * | 1/1999 | Schonmeier et al. | 242/541.7 |

FOREIGN PATENT DOCUMENTS

| | | |
|---|---|---|
| 1111496 | 7/1961 | (DE) . |
| 9201791 | 5/1992 | (DE) . |
| 4201815 | 7/1993 | (DE) . |
| 4219415 | 12/1993 | (DE) . |
| 4219485 | 12/1993 | (DE) . |
| 791549 | 8/1997 | (EP) . |

* cited by examiner

*Primary Examiner*—Donald P. Walsh
*Assistant Examiner*—William A. Rivera
(74) *Attorney, Agent, or Firm*—Greenblum & Bernstein, P.L.C.

(57) ABSTRACT

Reel winding device and process for supporting a winding reel. The device includes two support rolls arranged to form a winding bed adapted for receiving a winding reel, a compressed air support device having a pressure chamber arrangement with end sealing elements, and at least one of the end sealing elements including a sealing diaphragm arrangement that cooperates with a circumference of the winding reel. The process includes rotating the winding reel, positioning the at least one of the sealing elements in a vicinity of an axial end of the winding reel, blowing compressed air toward a circumferential surface of the winding reel, and adjusting a position of the sealing diaphragm in accordance with a diameter of the winding reel.

39 Claims, 3 Drawing Sheets

REEL WINDING DEVICE AND PROCESS FOR SUPPORTING A WINDING REEL

CROSS-REFERENCE TO RELATED APPLICATIONS

The present application claims priority under 35 U.S.C. §119 of German Patent Application No. 198 37 760.6, filed on Aug. 20, 1998, the disclosure of which is expressly incorporated by reference herein in its entirety.

BACKGROUND OF THE INVENTION

1. Field of the Invention

The present invention relates to a reel winding device having two support rolls that form a winding bed for receiving a winding reel, and a compressed air support device that has a pressure chamber arrangement with end sealing elements.

2. Discussion of Background Information

In one of the final steps of production, paper webs are commonly cut to the correct width and then wound onto reels before being packaged and delivered. The winding cores, onto which the paper reels are wound, have only relatively little rigidity and load-bearing capacity in contrast to the reel-spools used during paper production. They are often constructed, e.g., as cardboard tubes. This generally leads to the paper reels being supported during winding by supporting rolls. This is particularly pronounced when the winding device is structured as a support roll winding machine. In this process, the reel lies on support rolls without additional retention force being exerted on the core. However, even with a backup roll, with which additional retention force can be exerted on the core, the reel is supported on a roll. If the paper reels are larger and heavier, the linear support forces of the paper reel become relatively large on the support roll or rolls, which has the disadvantage of increasing the winding hardness. This can lead to a subsequent failure in the winding structure of the roll. To relieve the pressure on the reels and to reduce the linear force, pneumatic overpressure can be created under the reel so that at least part of the reel weight is supported by a cushion of air.

In order to form such an air cushion at a reasonable expense, measures must be taken to seal a space at least to a considerable extent. The support rolls are used for this purpose. A sealing plate or seal housing is positioned under the support rolls. In the winding bed, the paper reel itself serves as a seal. In current construction, the seal is provided in which a sealing plate having a shape adapted to the contour of the winding bed is positioned as tightly as possible on the ends of the paper reel. However, because it is impossible to achieve bearing contact in this arrangement, this negatively affects the paper web to be wound. In such cases, the sealing plate would also wear very quickly. For this reason, a space of several millimeters is left between the ends of the paper reel and the sealing plate. It is obvious that air escapes through this gap, and it does so in considerable quantities.

SUMMARY OF THE INVENTION

The present invention, therefore minimizes air consumption. In this regard, the present invention relates to a reel winding device of the type generally discussed above that includes at least one end sealing element with a sealing diaphragm arrangement that cooperates with the circumference of the winding reel.

Thus, in contrast to the sealing location known in the prior art, i.e., the end surface of the winding reel, the sealing location of the present invention can be shifted to the circumferential surface of the winding reel. In this regard, several advantages are achieved. For example, the circumferential surface of the winding reel is, generally, significantly smoother than the end surfaces, which results in a sealing diaphragm arrangement that can be positioned at a significantly smaller distance from the circumferential surface of the winding reel, e.g., a minimum distance of only 0.5 mm can be set. Further, the axial extension of the sealing diaphragm arrangement can be made somewhat larger, so that greater flow resistance can be created for the outflowing air. Accordingly, less air can escape through the sealing diaphragm arrangement that is directed against the circumference of the winding reel than with a seal that cooperates with the ends of the winding reel. In the context of the present invention, it is noted that the term "sealing diaphragm arrangement" is not limited to a plate-type formation, but includes all bodies or parts that cooperate with the circumference of the winding reel, and which thereby prevent, or at least impede, the escape of air at the ends. Of course, it is also practically impossible to achieve a hermetic seal at a reasonable expense with a seal that impinges on the circumference of the winding reel. This is because, in this arrangement as well, a seal must be made against three moving parts, namely against the two supporting (carrier) rolls and the winding, reel. However, by the present invention, air consumption can be kept to a minimum.

Preferably, the height of the sealing diaphragm arrangement and at least one support roll can be adjusted with respect to each other. This accommodates the fact that the diameter of the winding reel changes during winding. Since the support rolls have a constant distance relative to each other, the change in diameter means that the winding reel rises continuously above the winding bed, i.e., as the diameter increases, the reel lies more shallowly in the winding bed. If the height of the sealing diaphragm arrangement is adjustable, the desired small sealing gap can be substantially maintained at all times despite this change in seal geometry. This is true even when the axes of the support rolls do not lie in the same plane of elevation, or the diameters of the support rolls are unequal.

It is also advantageous if the sealing diaphragm arrangement has a sealing diaphragm of adjustable shape. Through this adjustable shape, diameter increases of the winding reel can be accommodated. When the diameter of the winding reel increases, a large "window," through which air can escape, develops on the ends. The shape of the sealing diaphragm can be adjusted either continuously or periodicially, i.e., from time to time, so that this window is covered as well as possible.

According to this process, it can be particularly advantageous if the width of the sealing diaphragm can be changed. As the diameter of the winding reel increases, support points of the winding reel on the support rolls move away from each other. If the width of the sealing diaphragm changes, then the support points of the winding reel on the support rolls can be followed. Thus, the opening through which air could escape can be kept small.

Alternately or additionally, a vertical distance from the end to the middle of the sealing diaphragms can be adjustable. For example, the sealing diaphragm can have a cross-sectional shape of a flat V, the aperture angle of which increases as the roll diameter increases.

The shape of the sealing diaphragm may be adjustable as a function of the height adjustment. For the support roll geometry presented above, the shape of the opening to be sealed is dependent on the increasing diameter of the winding reel. Naturally, the same is true for unwinding. As mentioned above, the increase in the diameter of the winding reel has two consequences. First, the lowest point of the circumference of the winding reel constantly moves upward, i.e., out of the winding bed. Secondly, the support points of the winding reel move outward along the surface of the support rolls. Since it is desirable, for the purpose of good sealing, to keep the sealing diaphragm as close as possible to the circumference of the winding reel, information about the "height position," i.e., concerning the vertical position of the sealing diaphragm, can be used at the same time for adjusting the shape set for a particular winding reel diameter as well, such as a particular width.

In a relatively simple embodiment, it can be provided that the sealing diaphragm is constricted of several parts that can move against each other. If the parts are moved relative to each other, the shape of the sealing diaphragm can be changed in a simple manner.

Here it is particularly preferable for the parts to be displaceable or pivotable relative to each other. Through displacement, for example, the width of the sealing diaphragm can be changed. The only prerequisite in this respect is that a certain overlapping exists between the parts of the sealing diaphragm, so that no new openings are formed during displacement.

It may be preferable for each part to be guided against a lifting device in a first guiding device and against a stationary mounting in a second guiding device. In this embodiment, when the part is lifted by means of the lifting device, a displacement transverse to the lifting direction is automatically effected. In so doing, the first guiding device permits the movement with respect to the lifting device. The second guiding device controls the lateral movement.

At least one of the two guiding devices can be structured as a linear guiding device, which can be easily produced. Thus, the danger that the part will become jammed or tilted is relatively small.

Alternately or additionally, it can be provided that two parts of the sealing diaphragm are structured as a pivoted lever. With such pivoted levers, it is also possible to follow the changing height position of the lowest point of the circumference of the winding reel. Pivoted levers are relatively easy to control.

Here it is advantageous for each pivoted lever to extend approximately from one support roll to the other and to have a stationary pivoting axis at one end. The two pivoted levers together cover at least approximately the entire width of the winding bed. Here, width refers to the distance between the two supporting rolls. Based on the arrangement of the pivoting axes, the two pivoted levers intersect as they rise, so that the lowest point formed jointly by the two pivoted levers together can follow the circumference of the winding reel.

The sealing diaphragm arrangement can preferably be attached to an end wall of the pressure chamber arrangement. This end wall can cover the majority of the cross section that remains open between the support rolls. Therefore, the end wall also extends to a position to which the winding reel dips at its smallest supported diameter, generally approximately 800 mm. The sealing diaphragm arrangement must then cover only the cross section that results from greater roll diameters. The end wall also provides a favorable opportunity for attachment.

The end wall can preferably travel parallel to the support rolls. Since compressed air support of the winding reel is necessary only beginning at a certain reel diameter, e.g., 800 mm as mentioned above, a relatively large cross section can already be covered through this measure without disturbing the structure of the winding reel. Provided that the winding reel has a smaller diameter, the end wall is moved away from the winding reel. Only at a larger diameter, at which the lowest point of the winding reel has risen far enough up from the winding bed, is the end wall set in place. Moreover, only at that time is pressure applied and, thus, it is only necessary to seal during the application of the air pressure.

Preferably, the sealing diaphragm arrangement has a tracking device with a drive and a sensor for the position of the winding reel. The drive serves to raise the sealing diaphragm arrangement, so that it follows the changing position of the circumference of the winding reel. The winding reel sensor is provided so that the sealing diaphragm arrangement can also remain as close as possible to the circumference. It reports back to the drive when the sealing diaphragm arrangement approaches a predetermined value on the circumference. When that condition is achieved, the drive interrupts the further raising of the sealing diaphragm arrangement. The winding reel sensor can be structured in several different ways. For example, it can be allowed to operate without contact, in a pneumatic, capacitive, inductive, or optical manner, or by a laser scanner. In this case, continuous adjustment by the drive is possible. A "sliding block" can also be brought into contact with the circumference of the winding reel. In this manner, the drive always raises the sealing diaphragm arrangement far enough so that the sliding block is in contact with the winding reel, or is in contact with it at a specific pressure. Continuous adjustment is possible in this case as well. Finally, circuit elements or tactile elements can also be used, which function in a capacitive, inductive, optical, pneumatic, or other suitable manner. With a winding reel sensor structured in this way, adjustment does not occur continuously, but in steps or stages. The drive raises the sealing diaphragm arrangement whenever a predetermined distance with respect to the circumference of the winding reel is exceeded.

The present invention relates to a reel winding device that includes two support rolls arranged to form a winding bed adapted for receiving a winding reel, a compressed air support device having a pressure chamber arrangement with end sealing elements, and at least one of the end sealing elements including a sealing diaphragm arrangement that cooperates with a circumference of the winding reel.

According to a feature of the invention, the sealing diaphragm arrangement can be positionably adjustable to a height with respect to at least one of the two support rolls.

According to another feature of the present invention, the sealing diaphragm arrangement may include a sealing diaphragm having a variable shape. Further, the sealing diaphragm may have an adjustable width. Still further, the sealing diaphragm can have ends and a middle, such that a vertical distance between the ends and the middle of the sealing diaphragm is adjustable. The sealing diaphragm can include a variable shape which is adjustable in accordance with a positioned height of the sealing diaphragm. Moreover, the sealing diaphragm can include movable elements arranged to move relative to each other. In this regard, the movable elements are at least one of displaceable and pivotable relative to each another. The device can also include a lifting device having a first guiding slot, and a stationary guiding device having a second guiding slot. Each of the movable elements can be coupled for movement along the first guiding slot and the second guiding slot. The lifting device may be adapted to impart movement such that the movable elements are moved along the first guiding slot and the second guide slot. At least one of the first and second guiding slots can be structured as a linear guiding device. Further still, the movable elements can include pivoted levers, and each pivoted lever can include a stationary pivoting axis located at an end of the pivoted lever, and each pivoted lever can be positioned to extend approximately between the two support rolls.

In accordance with still another feature of the present invention, the pressure chamber arrangement can include an end wall, and the sealing diaphragm arrangement can be coupled to the end wall. Further, the end wall may be arranged for movement parallel to the two support rolls.

According to a further feature of the present invention, the sealing diaphragm arrangement may include a tracking device that includes a drive and a sensor, and the tracking device may be adapted for monitoring a position of the winding reel. Further, the tracking device can include one of a contactless sensor and a contact sensor. The contactless sensor can include one of capacitive, inductive, optical, pneumatic sensor, and the contact sensor can include a sliding block. A pressure sensing device can be adapted for monitoring a contact pressure between the sliding block and the winding reel.

The present invention also relates to a process for supporting a winding reel on an apparatus that includes a winding bed formed by two support rolls, a compressed air support device with a pressure chamber arrangement and sealing elements, at least one of which includes a sealing diaphragm. The process includes rotating the winding reel, positioning the at least one of the sealing elements in a vicinity of an axial end of the winding reel, blowing compressed air toward a circumferential surface of the winding reel, and adjusting a position of the sealing diaphragm in accordance with a diameter of the winding reel.

In accordance with a feature of the invention, the blowing of compressed air occurs once the winding reel attains a diameter of approximately 800 mm.

According to another feature of the instant invention, the process may include measuring a distance between the sealing diaphragm and the circumferential surface of the winding reel.

According to a further feature of the present invention, the process can further include maintaining a distance of at least approximately 0.5 mm between the sealing diaphragm and the circumferential surface of the winding reel.

According to a still further feature of the invention, the adjusting of the sealing diaphragm can include moving the sealing diaphragm upwardly toward the winding reel. Further, the sealing diaphragm can include at least two movable elements, and the adjusting of the sealing diaphragm may further include moving the at least two movable elements relative to each other and outwardly in a direction substantially perpendicular to a winding reel axis and/or relative to each other and along a path oblique to the upward movement directions.

Other exemplary embodiments and advantages of the present invention may be ascertained by reviewing the present disclosure and the accompanying drawing.

BRIEF DESCRIPTION OF THE DRAWINGS

The present invention is further described in the detailed description which follows, in reference to the noted plurality of drawings by way of non-limiting examples of exemplary embodiments of the present invention, in which like reference numerals represent similar parts throughout the several views of the drawings, and wherein.

DETAILED DESCRIPTION OF THE PRESENT INVENTION

Figure 1B:
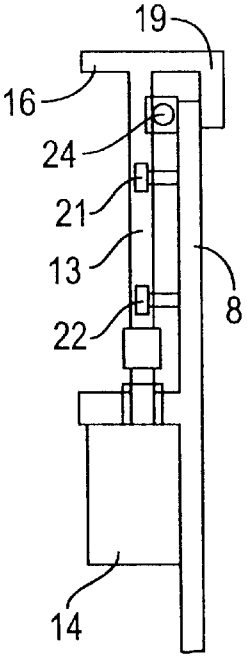
FIGS. 1A and 1B illustrate a front and sectional side view, respectively, of a first embodiment of the instant invention.

The particulars shown herein are by way of example and for purposes of illustrative discussion of the embodiments of the present invention only and are presented in the cause of providing what is believed to be the most useful and readily understood description of the principles and conceptual aspects of the present invention. In this regard, no attempt is made to show structural details of the present invention in more detail than is necessary for the fundamental understanding of the present invention, the description taken with the drawings making apparent to those skilled in the art how the several forms of the present invention may be embodied in practice.

The present invention is described herein by way of example to paper reels. However, this discussion is intended solely for the purpose of explanation and should not be construed as in any way limiting the present invention to any particular embodiment or to any specific type of winding reel.

Each figure (A and B) shows the sealing diaphragm arrangement respectively in a front view and in a sectional side view along the center axis.

First, with reference to FIGS. 1A and 1B, the features common to all embodiments will be described.

A reel winding device 1, of which only the part necessary for the explanation is shown, has a first support (carrier) roll 2 and a second support (carrier) roll 3, that form a winding bed 4 between them. A winding reel 5 is positioned to lie in winding bed 4. Winding reel 5 is shown with a first circumferential line 6 for a first (smaller) diameter and a second circumferential line 7, which results when the diameter of the winding reel has increased. As the diameter of winding roll 5 increases, the circumference of winding roll increases such that second circumferential line 7 is less curved than first circumferential line 6.

Between the two winding reels 2 and 3 an end wall 8, which is adjustable to the shape of support rolls 2 and 3, is positioned to cover or fill most of the clear opening between support rolls 2 and 3. End wall S can be structured and arranged to be displaced parallel to support rolls 2 and 3. In this manner, a position of end wall 8 can be adjusted within the winding device to reels of differing axial lengths. While not shown in further detail, winding bed 4 can be sealed underneath. An air supply connection (not illustrated) may be provided, either from below or from one of the ends, to feed compressed air into a space bounded by support rolls 2 and 3, winding reel 5, and end walls 8 (i.e., a similar end wall is located on the opposite side of winding reel 5).

End wall 8 extends to just below the first circumferential line 6 formed by the circumference of winding reel 5, which represents a diameter of the winding reel when the application of compressed air becomes necessary to offset the increasing weight of the winding reel. This diameter is generally on the order of, e.g., approximately 800 mm.

When winding reel 5 has attained the diameter represented by first circumferential line 6, a first contact point 9, or more accurately a first contact line 9, extends parallel to the axis of support roll 2. When the diameter has increased to the extent that winding reel 5 attains second circumferential line 7, the contact is displaced to a second contact line 10. This is likewise true for support roll 3.

When the contact line moves from line 9 to line 10, i.e., when the contact lines are displaced upwards, the curvature of the circumference of winding reel 5 decreases. Accordingly, the lowest point of winding reel 5 rises, as can be seen by comparing the circumferential lines 6 and 7.

End wall 8, as stated, covers most of the end of the clear space that is formed by support rolls 2 and 3 and winding reel 5. While a small opening 11 remains, this is not critical. In fact, a hermetic sealing of this space is practically impossible at a reasonable expense, and it is also unnecessary provided that the lack of sealing remains within certain limits. In this regard, the increasing size of the opening resulting from the changing circumference of winding reel 5 changes would be critical because this opening could attain dimensions through which a considerable, and unacceptably large, quantity of air could escape.

For this reason, a sealing diaphragm arrangement 12 is attached to end wall 8. Sealing diaphragm arrangement has a support 13 that can be raised by a lifting cylinder 14, from a position 15 shown in dashes to the position shown in continuous lines.

On support 13, a sealing diaphragm 16 is positioned that cooperates with the circumference of winding reel 5. Within sealing diaphragm 16 a sensor 17 can be located, which may be structured as, e.g., a contactless proximity sensor to generate a signal when winding reel 5 is at a distance from sealing diaphragm 16 that exceeds a predetermined value, e.g., approximately 0.5 mm.

Sensor 17 can be connected with lifting cylinder 14 or its control. Lifting cylinder 14 can be controlled so that sealing diaphragm 16 always remains as close as possible to the circumference of winding reel 5.

At the start of the winding process, a reel core, such as a cardboard tube, is inserted into winding bed 4. By rotation of support rolls 2 and 3, winding reel 5 turns and draws a web onto it. During winding, the diameter increases and winding reel 5 gradually moves upwardly. As soon as enough space is available under the winding reel, end walls 8 are driven axially inwardly until sealing diaphragms 16 are located under winding reel 5 and advantageously sealed against or are located slightly above the end of winding reel 5. In this case, no accurate axial adjusting takes place. Then, lifting cylinder 14 can raise support 13 until sensor 17 signals that sealing diaphragm 16 is nearly in contact with the circumference of winding reel 5. Initially, this position 18 is indicated in dashes; as the diameter of winding reel 5 increases. lifting cylinder 14 raises support 13 and sealing diaphragm 16 continuously, so that while opening 11 does increase somewhat in size, the majority of the space between support rolls 2 and 3 and winding reel 5 remains covered. Here, sealing diaphragm 16 can also have an apron 19 that cooperates with end wall 8 to prevent an opening from forming under it.

In the present embodiment, support 13 has a longitudinal slot 20 in which two pins 21, 22 engage to ensure vertical guidance of support 13. Support 13 can be supported in an axial direction by rolls 23 and 24, however, other guiding devices for the supports are also conceivable. Sealing diaphragm 16 can be arranged on a support in the shape of, e.g., an inverted U that is guided on a guide rail. Roller bearings can also be used instead of the illustrated rolls. Basically, any known type of guidance that permits vertically directed movement of sealing diaphragm 16 can be used.

Figure 1A:
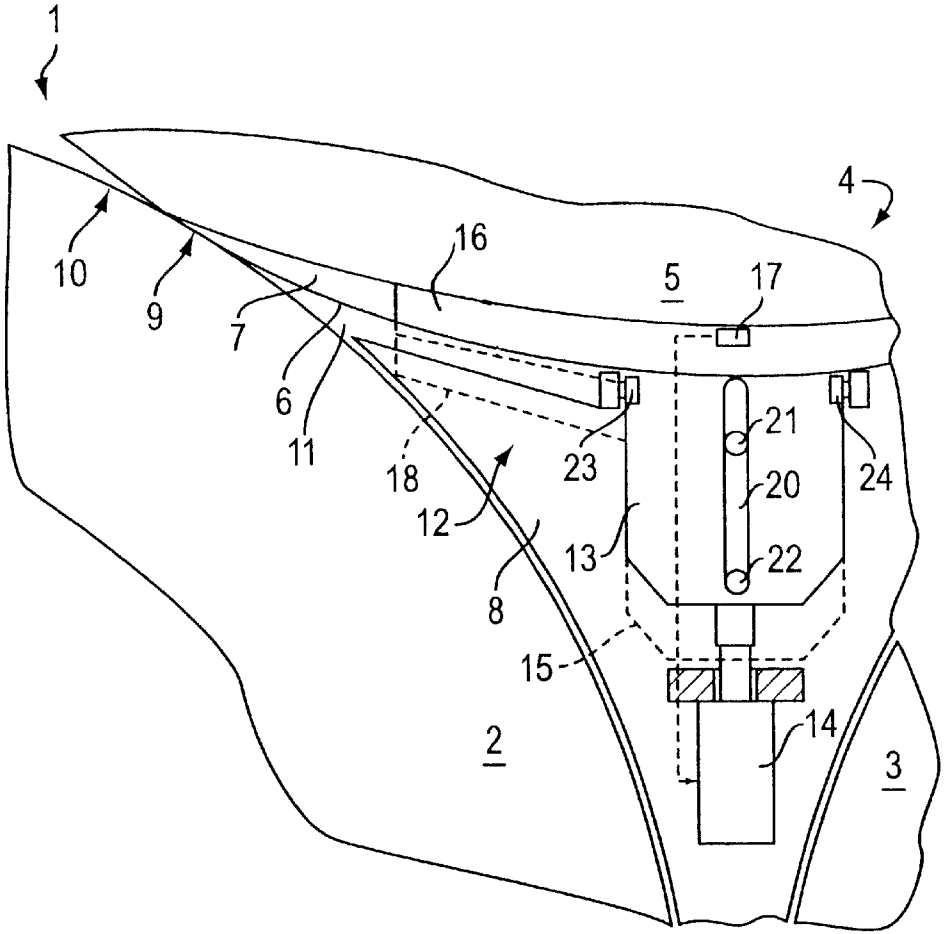
Figure 2B:
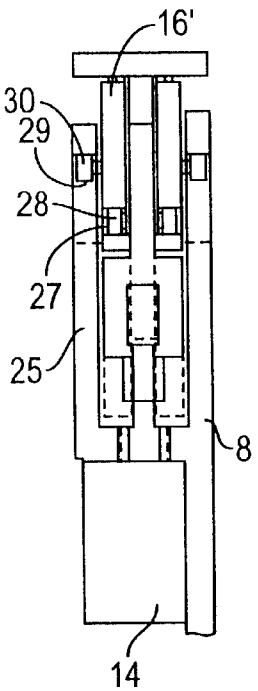
FIGS. 2A and 2B illustrate a front and sectional side view, respectively, of a second embodiment of the instant invention.
Figure 2A:
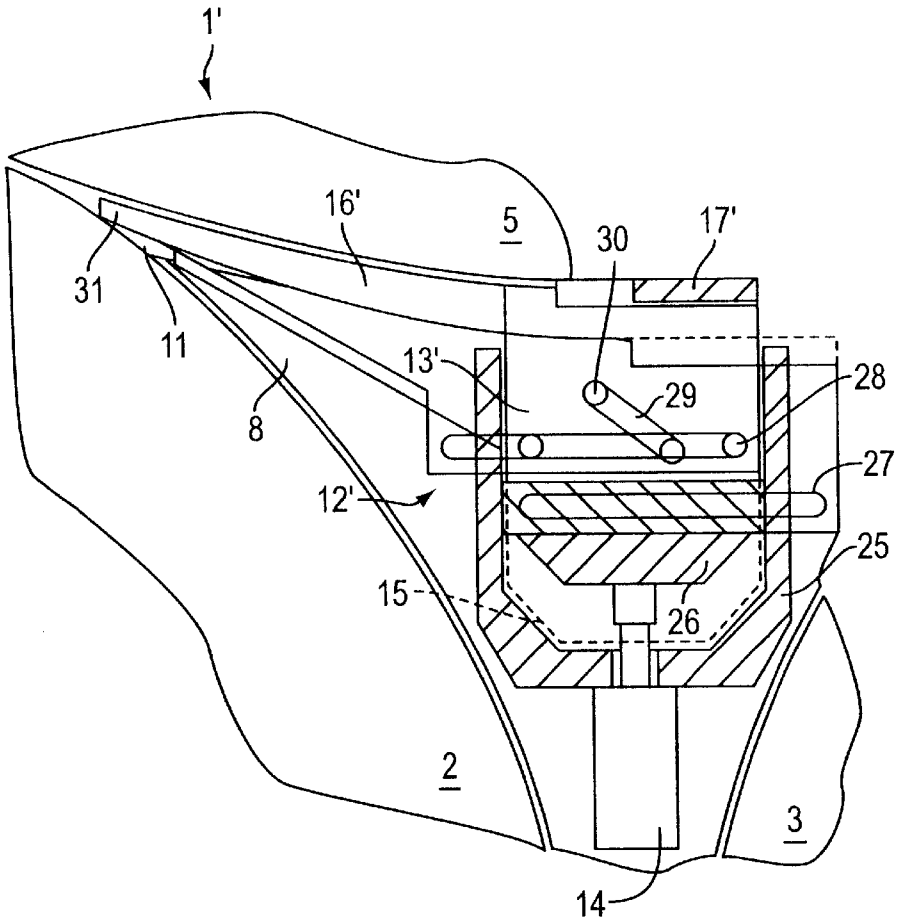

In the embodiment according to FIGS. 1A and 1B, opening 11 increases in size as the diameter of reel 5 increases. FIGS. 2A and 2B show a modified embodiment of a reel winding device 1', in which this occurrence is largely prevented. Identical parts are designated with the same reference numbers. Modified parts are identified by primed reference numbers.

Sealing diaphragm 16' in this embodiment is divided into two parts. For reasons of clarity, only the left half, i.e., one part, of sealing diaphragm 16' is shown in the front view in FIG. 2A. The presence of two sealing diaphragms is shown, however, in the sectional side view of FIG. 2B.

Support 13' is arranged on an elevating platform 26, which can be displaced vertically in the guiding device 25, under the effect of lifting cylinder 14. In this construction, support 13' has a horizontal slot 27 into which pins 28, which are attached to elevating platform 26, engage. Accordingly, support 13' and, therefore, sealing diaphragm 16' can be moved in the direction of width (i.e., in the direction between support rolls 2 and 3) with respect to elevating platform 26.

This movement is controlled by an inclined slot 29 provided in guiding device 25. Pin 30 connected to support 13' engages in slot 29. Therefore, when elevating platform 26 is raised, pin 30 is pressed to the left in slot 29, which, therefore, displaces support 13' to the left. In this manner, left tip 31 of sealing diaphragm 16' is pushed further into the space between support roll 2 and winding reel 5. Thus, opening 11 being enlarged between support roll 2 and winding reel 5, due to the increasing diameter of the winding reel 5, can be increasingly covered by sealing diaphragm 16'.

The same arrangement is also provided for the right side, thus, for reasons of clarity it is not shown. However, it is obvious that the two halves of sealing diaphragm 16' must overlap so as not to create a new opening as the components are moved apart.

In this instance, sensor 17' is formed by a "sliding block" that is in contact with the circumference of winding reel 5. Thus, sensor 17' can be, e.g., structured as a pressure sensor. When the pressure on sensor 17' decreases, lifting cylinder 14 raises elevating platform 26, so that sealing diaphragm 16' is also raised and moved apart. Through this change in shape, it is possible to keep the unsealed area small even at larger reel diameters. Of course, other touching or contactless sensors can also be used instead of the sliding block.

Of course, various modifications may also be undertaken with this embodiment. Instead of U-shaped guiding device 25 as illustrated, elevating platform 26 can also be guided between rolls. Pin 28 can also be provided on support 13', and the slot for it can be provided in elevating platform 26. In a similar manner, it is also possible to provide pin 30 not on support 13', but on housing 25, if a corresponding slot 29 of identical function is then provided on support 13'. Instead of sensor 17', a touch contact may also be used that sends an activation signal to lifting cylinder 14 whenever the winding reel moves more than a predetermined distance from sealing diaphragm 16'. The course of guiding devices 29 and 30 can also be something other than a straight line, if the lifting movement and the extending movement do not have a linear relationship to each other. A straight line, however, will suffice in most cases even if it does not correspond absolutely to the ideal course of the control curve.

Figure 3B:
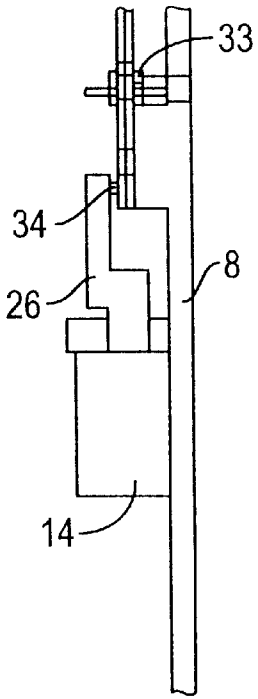
FIGS. 3A and 3B illustrate a front and sectional side view, respectively, of a third embodiment of the instant invention.
Figure 3A:
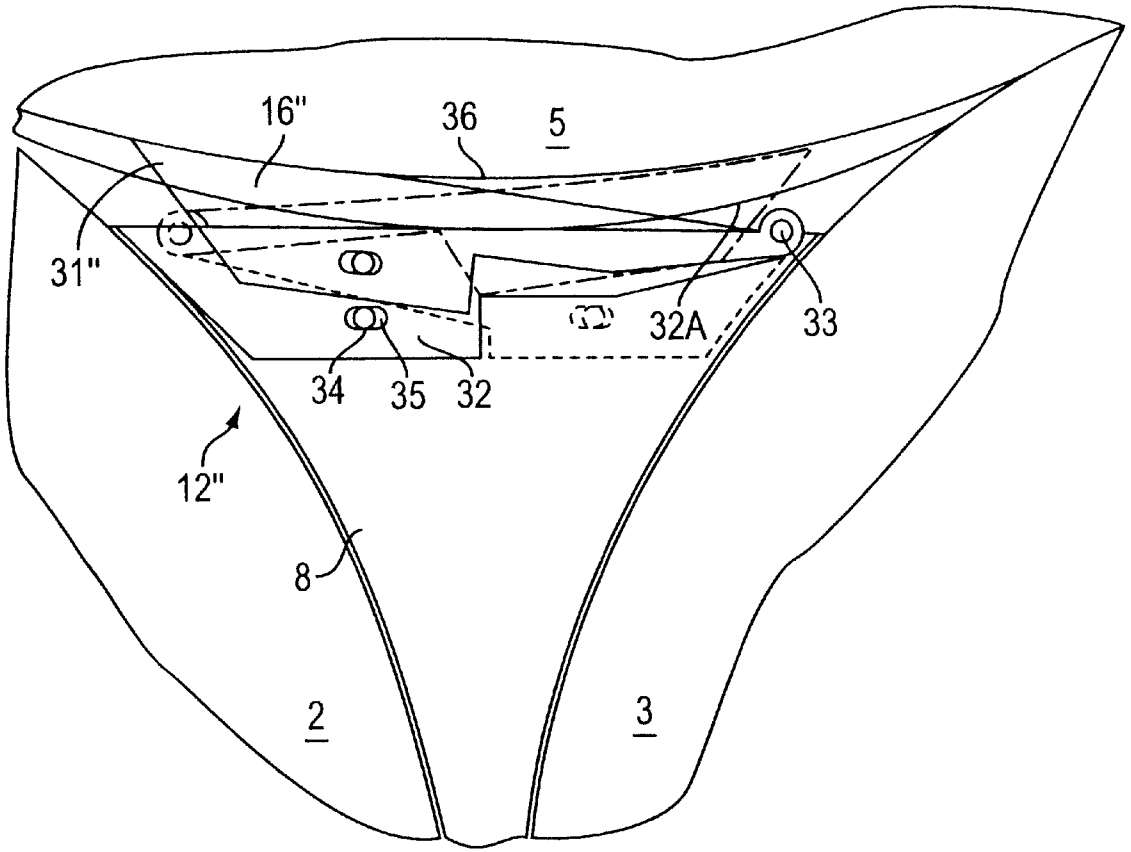

FIGS. 3A and 3B illustrate a third embodiment in a front and sectional sectional view, in which identical parts are marked with identical reference numbers, and corresponding parts are marked with a double prime symbol. In this embodiment, once again, there is a sealing diaphragm 16" that changes shape as the diameter of the reel increases. Sealing diaphragm 16" has two levers 32 that extend, in the resting position, between support roll 3 and support roll 2. In this resting position, the top of the pivoted lever 32 runs practically horizontally. However, it is apparent that an adjustment to the curvature of the circumferential surface of winding reel 5 can be made here.

Pivoted lever 32 can be pivotably mounted on a pivoting axis 33 in the vicinity of support roll 3. Lifting cylinder 14, via an elevating platform 26, impinges or acts on a pin 34 that is positioned in a longitudinal aperture 35 in pivoted lever 32, i.e., in portion of pivoted lever 32 that is located opposite pivoting axis 33. When lifting cylinder 14 then raises elevating platform 26, the angle of inclination of pivoted lever 32 changes. The left tip 31" is raised, thereby following the rising circumferential surface of the winding reel 5. The right pivoted lever 32A is also shown in dashes. It is raised to the same extent by a movement of lifting cylinder 26. Accordingly, the "point of intersection" 36 of pivoted levers 32 and 32A can also move upward. In this manner, as well, it can be ensured that the aperture not covered by end wall 8 remains small.

Instead of sealing diaphragm arrangements 12, 12', 12" shown, which are made respectively of one or more rigid parts, sealing diaphragm arrangements made of deformable bodies can also be used. For example, instead of sealing diaphragm 16 and motion device 14, a tube that can be inflated with compressed air or another compressed fluid may be used. Initially, i.e., at the start of the winding process, such a tube can be flush with the upper edge of end wall 8, i.e., the edge facing toward reel 5, up to a winding reel diameter of approximately 800 mm. When a gap occurs as the reel diameter increases, the tube can be inflated. When the tube is in contact with the circumference of the reel, the gap is sealed.

In the embodiments shown in FIGS. 2A and 3A, a tube located on the edges of the corresponding diaphragms facing reel 5 can be used in addition to diaphragm 16' and 16". Instead of a tube, of course, an inflatable cushion may be used, i.e., it is not a precondition that the diameter of the tube must be small with respect to its length. The side of such a tube or air cushion in contact with the reel is then preferably equipped with a coating that reduces friction.

It is noted that the foregoing examples have been provided merely for the purpose of explanation and are in no way to be construed as limiting of the present invention. While the present invention has been described with reference to an exemplary embodiment, it is understood that the words which have been used herein are words of description and illustration, rather than words of limitation. Changes may be made, within the purview of the appended claims, as presently stated and as amended, without departing from the scope and spirit of the present invention in its aspects. Although the present invention has been described herein with reference to particular means, materials and embodiments, the present invention is not intended to be limited to the particulars disclosed herein; rather, the present invention extends to all functionally equivalent structures, methods and uses, such as are within the scope of the appended claims.

What is claimed:

1. A reel winding device comprising:

two support rolls arranged to form a winding bed adapted for receiving a winding reel;

a compressed air support device having a pressure chamber arrangement with end sealing elements; and at least one of the end sealing elements including a sealing diaphragm arrangement that cooperates with a circumference of the winding reel, wherein the sealing diaphragm arrangement is adjustably movable upwardly toward the winding reel.

2. The device in accordance with claim 1, wherein the sealing diaphragm arrangement is positionably adjustable to a height with respect to the two support rolls.

3. The device in accordance with claim 1, wherein the sealing diaphragm arrangement comprises a sealing diaphragm having a shape which can be varied.

4. The device in accordance with claim 3, wherein the sealing diaphragm has an adjustable width.

5. The device in accordance with claim 3, wherein the sealing diaphragm has ends and a middle, wherein a vertical distance between the ends and the middle of the sealing diaphragm is adjustable.

6. The device in accordance with claim 3, wherein the sealing diaphragm comprises a variable shape which is adjustable in accordance with a positioned height of the sealing diaphragm.

7. The device in accordance with claim 3, wherein the sealing diaphragm comprises movable elements arranged to move relative to each other.

8. The device in accordance with claim 7, wherein the movable elements is at least one of displaceable and pivotable relative to each another.

9. The device in accordance with claim 8, further comprising:

a lifting device having a first guiding slot;

a stationary guiding device having a second guiding slot; and each of the movable elements being coupled for movement along the first guiding slot and the second guiding slot;

wherein the lifting device is adapted to impart movement such that the movable elements are moved along the first guiding slot and the second guide slot.

10. The device in accordance with claim 9, wherein at least one of the first and second guiding slots is structured as a linear guiding device.

11. The device in accordance with claim 7, wherein the movable elements comprise pivoted levers.

12. The device in accordance with claim 11, wherein each pivoted lever comprises a stationary pivoting axis located at an end of the pivoted lever; and wherein each pivoted lever is positioned to extend approximately between the two support rolls.

13. The device in accordance with claim 1, wherein the pressure chamber arrangement comprises an end wall; and wherein the sealing diaphragm arrangement is coupled to the end wall.

14. The device in accordance with claim 13, wherein the end wall is arranged for movement parallel to the two support rolls.

15. The device in accordance with claim 1, wherein the sealing diaphragm arrangement comprises a tracking device that includes a drive and a sensor; and wherein the tracking device is adapted for monitoring a position of the winding reel.

16. The device in accordance with claim 15, wherein the tracking device comprises one of a contactless sensor and a contact sensor.

17. The device in accordance with claim 16, wherein the contactless sensor comprises one of a capacitive, an inductive, an optical, and a pneumatic sensor.

18. The device in accordance with claim 16, wherein the contact sensor comprising a sliding block.

19. The device in accordance with claim 18, further comprising a pressure sensing device which is adapted for monitoring a contact pressure between the sliding block and the winding reel.

20. A process for supporting a winding reel on an apparatus that includes a winding bed formed by two support rolls, a compressed air support device with a pressure chamber arrangement and sealing elements, at least one of which includes a sealing diaphragm, the process comprising:

rotating the winding reel;

positioning the at least one of the sealing elements adjacent an axial end area of the winding reel;

blowing compressed air toward a circumferential surface of the winding reel; and adjusting a position of the sealing diaphragm in accordance with a diameter of the winding reel, wherein the adjusting of the position, of the sealing diaphragm comprises moving the sealing diaphragm upwardly toward the winding reel.

21. The process in accordance with claim 20, wherein the blowing of compressed air occurs when the winding reel attains a diameter of approximately 800 mm.

22. The process in accordance with claim 20, further comprising measuring a distance between the sealing diaphragm and the circumferential surface of the winding reel.

23. The process in accordance with claim 20, further comprising maintaining a distance of at least approximately 0.5 mm between the sealing diaphragm and the circumferential surface of the winding reel.

24. The process in accordance with claim 20, wherein the sealing diaphragm includes at least two movable elements, and the adjusting of the sealing diaphragm further comprises moving the at least two movable elements relative to each other and outwardly in a direction substantially perpendicular to a winding reel axis.

25. The process in accordance with claim 20, wherein the sealing diaphragm includes at least two movable elements, and the adjusting of the sealing diaphragm further comprises moving the at least two movable elements relative to each other and along a path oblique to the upward movement directions.

26. A reel winding device comprising:

two support rolls arranged to form a winding bed adapted for receiving a winding reel;

a compressed air support device having a pressure chamber arrangement with end sealing elements; and at least one of the end sealing elements including a sealing diaphragm arrangement that cooperates with a circumference of the winding reel, the sealing diaphragm arrangement comprising a sealing diaphragm having a shape which can be varied, ends and a middle, wherein a vertical distance between the ends and the middle of the sealing diaphragm is adjustable.

27. A reel winding device comprising:

two support rolls arranged to form a winding bed adapted for receiving a winding reel;

a compressed air support device having a pressure chamber arrangement with end sealing elements; and at least one of the end sealing elements including a sealing diaphragm arrangement that cooperates with a circumference of the winding reel, the sealing diaphragm arrangement comprising a sealing diaphragm having a shape which can be varied, wherein the shape of the sealing diaphragm is adjustable in accordance with a positioned height of the sealing diaphragm.

28. A reel winding device comprising:

two support rolls arranged to form a winding bed adapted for receiving a winding reel;

a compressed air support device having a pressure chamber arrangement with end sealing elements; and at least one of the end sealing elements including a sealing diaphragm arrangement that cooperates with a circumference of the winding reel, the sealing diaphragm arrangement comprising a sealing diaphragm having a shape which can be varied, wherein the sealing diaphragm comprises movable elements arranged to move relative to each other.

29. The device in accordance with claim 28, wherein the movable elements is at least one of displaceable and pivotable relative to each another.

30. The device in accordance with claim 29, further comprising:

a lifting device having a first guiding slot;

a stationary guiding device having a second guiding slot; and each of the movable elements being coupled for movement along the first guiding slot and the second guiding slot;

wherein the lifting device is adapted to impart movement such that the movable elements are moved along the first guiding slot and the second guide slot.

31. The device in accordance with claim 30, wherein at least one of the first and second guiding slots is structured as a linear guiding device.

32. The device in accordance with claim 28, wherein the movable elements comprise pivoted levers.

33. The device in accordance with claim 32, wherein each pivoted lever comprises a stationary pivoting axis located at an end of the pivoted lever; and wherein each pivoted lever is positioned to extend approximately between the two support rolls.

34. A reel winding device comprising:

two support rolls arranged to form a winding bed adapted for receiving a winding reel;

a compressed air support device having a pressure chamber arrangement with end sealing elements;

at least one of the end sealing elements including a sealing diaphragm arrangement that cooperates with a circumference of the winding reel;

the sealing diaphragm arrangement comprising a tracking device that includes a drive and a sensor; and the tracking device adapted for monitoring a position of the winding reel.

35. The device in accordance with claim 34, wherein the tracking device comprises one of a contactless sensor and a contact sensor.

36. The device in accordance with claim 35, wherein the contactless sensor comprises one of a capacitive, an inductive, an optical, and a pneumatic sensor.

37. The device in accordance with claim 35, wherein the contact sensor comprising a sliding block.

38. The device in accordance with claim 37, further comprising a pressure sensing device which is adapted for monitoring a contact pressure between the sliding block and the winding reel.

39. A process for supporting a winding reel on an apparatus that includes a winding bed formed by two support rolls, a compressed air support device with a pressure chamber arrangement and sealing elements, at least one of which includes a sealing diaphragm, the process comprising:

rotating the winding reel;

positioning the at least one of the sealing elements in a vicinity of an axial end of the winding reel;

blowing compressed air toward a circumferential surface of the winding reel;

measuring a distance between the sealing diaphragm and the circumferential surface of the winding reel; and adjusting a position of the sealing diaphragm in accordance with a diameter of the winding reel.

* * * * *